US007474222B2

(12) United States Patent
Yang et al.

(10) Patent No.: US 7,474,222 B2
(45) Date of Patent: Jan. 6, 2009

(54) DISPOSABLE, SINGLE USE SECURITY TAG

(76) Inventors: Xiao Hui Yang, 7926 McClellan Rd., #3, Cupertino, CA (US) 95014; Arthur Bradley Fuss, 4235 Mary Ellen, #310, Studio City, CA (US) 91604

( * ) Notice: Subject to any disclaimer, the term of this patent is extended or adjusted under 35 U.S.C. 154(b) by 107 days.

(21) Appl. No.: 11/060,156

(22) Filed: Feb. 17, 2005

(65) Prior Publication Data

US 2005/0270161 A1 Dec. 8, 2005

Related U.S. Application Data

(63) Continuation-in-part of application No. 10/671,157, filed on Sep. 25, 2003.

(60) Provisional application No. 60/468,459, filed on May 6, 2003.

(51) Int. Cl.
*G08B 13/14* (2006.01)

(52) U.S. Cl. ..... 340/572.8; 340/572.1; 340/572.5; 340/572.9; 24/704.1; 70/57.1

(58) Field of Classification Search ..... 340/572.8, 340/572.1, 572.5, 572.9; 70/57.1; 335/306; 24/704.1, 706.8
See application file for complete search history.

(56) References Cited

U.S. PATENT DOCUMENTS

| | | | | |
|---|---|---|---|---|
| 4,940,968 | A * | 7/1990 | De Nood | 340/572.5 |
| 4,993,245 | A * | 2/1991 | Ott | 70/57.1 |
| 6,084,498 | A * | 7/2000 | Stelter et al. | 335/306 |
| 6,722,166 | B2 * | 4/2004 | Skjellerup | 70/57.1 |
| 6,912,878 | B2 * | 7/2005 | Belden, Jr. | 70/57.1 |
| 7,073,236 | B2 * | 7/2006 | Xue et al. | 24/704.1 |
| 7,190,272 | B2 * | 3/2007 | Yang et al. | 340/572.8 |

* cited by examiner

*Primary Examiner*—Davetta W Goins
(74) *Attorney, Agent, or Firm*—Colin P. Abrahams

(57) ABSTRACT

An single use, disposable electronic article surveillance tag is claimed wherein the tag features a spindle assembly which anchors and retains a set of ball bearings which are used to clutch and retain the shaft of a tack. The spindle features an operational tab which may be contacted by the appropriate probe to turn the spindle about a central axis.

15 Claims, 2 Drawing Sheets

DISPOSABLE, SINGLE USE SECURITY TAG

CROSS REFERENCE TO RELATED APPLICATIONS

This application is a continuation-in-part application of U.S. patent application Ser. No. 10/671,157 filed Sep. 25, 2003, which claims the benefit of U.S. Provisional Application 60/468,459, filed on May 6, 2003, both of which are incorporated herein by reference in their entirety.

BACKGROUND OF THE INVENTION

This application relates to an electronic disposable, single use security or surveillance tag for use in protecting an item for/from shoplifting by producing an electronic signal upon entry into a pre-defined zone of interrogation. The present invention is directed to an Electronic Article Surveillance (EAS) Tag for use in shoplifting deterrence and inventory control in a retail establishment.

Security tags have been used for many years as a means of deterring retail shoplifting in clothing stores, electronic stores, and a myriad of other retail establishments. Generally speaking, an electronic article surveillance system will consist of a durable and reliable, yet small, sensor tag which is affixed to the article to be detected in such a way that it cannot be easily removed by a customer in the store. Usually, the system depends on the feature that the attachment mechanism is constructed such that it can only be removed by the user of a specialized tool which is only in possession of the store personnel at the checkout register or exit port for the establishment. In the event that an security tag is not removed from a protected article prior to exiting the store, an alarm or other signal is activated.

In order for an EAS system to be reliable, the security tag must be effective in that a shoplifter will be unable to remove it within the store. In some systems, the tag is encapsulated with an ink cartridge which will open and permanently destroy the protected item and make a considerable mess in the process. In other systems, the tag is anchored with an attachment mechanism that will cause destruction of the article if it is pulled or ripped from the article. In addition, the tag anchoring mechanism must be rigid enough to withstand efforts to crack it open within the store. In short, the security tag must be called upon to perform reliably amid challenges by the most clever and aggressive shoplifters.

Although an assortment of attachment mechanisms are available in the prior art, one of the more common and most successful attachment mechanism consists of a tack which is used to physically pin the protected article to the security tag base. The tag base is usually constructed of a hard and durable plastic and is generally in the neighborhood of three inches long. The tag serves as a housing for an electronic signal generation means secured within the housing, and which is designed to be immune to tampering. The security system is further characterized by one or more system receiver/transmitters which generate an interrogation zone in the general vicinity of the exit door to the retail establishment. The interrogation zone is usually defined by the installation of a pair of transmitters on each side of the exit doorway. When a security tag is moved into or through the surveillance zone, the electronic transmitter within the security tag will cause a signal to be generated which will be received by a system receiver to indicate that an unauthorized presence of a tagged article has been detected within the interrogation zone. Accordingly, alarms may sound or personnel may otherwise be alerted to the event such that the shoplifting can be thwarted at the exit port of the retail establishment.

Most of the tack-based security tags are constructed such that the tags which are removed at the checkout register may be re-attached to other merchandise for reuse. In general, the tack of the security tag may be removed through the operation of a specialized detaching mechanism by store personnel. In some systems, the detaching mechanism includes a probe which is inserted within the security tag to trigger a release latch located deep within the interior of the security tag and generally beyond the reach of foreign objects which could be used by a shoplifter, such as safety pins, pencils, wire probes and the like. In other systems, magnetic detachers are used that have a magnetic strength anywhere between 150 and 750 Gauss. These systems use a magnetic force to release the pin or tack from a clutching mechanism. Both magnetic and mechanical detachment systems are popular in retail establishments today.

In the patent art, electronic security tags have claimed a variety of specific forms and constructions over the years, and a wide assortment of attachment mechanisms have been claimed. An EAS tag featuring a tack which is releasably retained within the tag housing is generally well known in the art although the tack retention and release means have been the subject of numerous innovations. One such tag that has been commonly used in prior art systems is that claimed in U.S. Pat. No. 5,426,419 (Nguyen) entitled "Security Tag Having Arcuate Channel and Detacher Apparatus for Same". The Nguyen tag is comprised of a tack and a tag body. The tack shaft is inserted through a pin hole in the tag body and the tack is retained within the tag by a clutching mechanism. In order to release the clutching mechanism, a specific arcuate-shaped detachment tool must be inserted through an opening in the end of the tag. The opening within which the disengagement probe must be inserted features an arcuate channel which leads from the opening to the release trigger for the clutching means. The arcuate probe and channel provide a measure of security since it would difficult for a shoplifter to insert a foreign object having the proper shape into the tag for release of the clutching means. A similar tag construction is found in U.S. Pat. No. 5,528,914 (Nguyen) wherein an EAS tag is releasably attached to the protected item with a spring clamp and a tack which is clamped to the tag body using a clutch-lock assembly. The detaching mechanism includes a probe adapted for insertion into the tag along with a drive means and timing means for controlling the energization of the drive such that it properly engages the release mechanism for the clutch-locked tack or spring clamp. Although novel in many respects, the Nguyen devices require yet another expensive detachment device which complicates the checkout area in the retail establishment. Multiple styles of detachment operation systems require too much space from the perspective of the retailer.

U.S. Pat. No. 6,215,400 (Rand) discloses a security tag consisting of a security anchor with a central aperture. A security wire is threaded through the aperture in the anchor and is held securely. A PC board which includes a presence-detection diode is connected to one end of the security wire. Although perhaps effective as a shoplifting deterrent, the Rand mechanism is quite cumbersome and labor intensive to install and utilize.

U.S. Pat. No. 6,255,950 (Nguyen) discloses a tag assembly wherein the tack is modified to include a biasing structure such as a compression spring oriented within a tack assembly housing. The biasing structure serves to move the tack head and tack between an extended position and retracted position. In the extended position, the tack extends from the aperture in the tack housing and can be pushed through the article and into the receiving aperture of the security tag. In the retracted position, the tack is positioned entirely within the tack housing such that the point of the tack is not exposed and therefore cannot cause injury to store personnel or others.

U.S. Pat. No. 6,373,390 (Hogan) entitled "Electronic Article Surveillance Tag Having Arcuate Channel" features a tag body with an arcuate channel wherein an arcuate shaped detaching probe is used to release a tack from the security tag housing. The structure includes a spring clamp mechanism which provides the resistance to hold the shaft of the tack in place within the tag housing. The improvement disclosed by Hogan is the inclusion of an abutment means within the arcuate channel such as to prevent the insertion of a wire into the channel for contract with the releasing mechanism. In general, the abutment means consists of a rigid planar abutment within the detachment channel.

U.S. Pat. No. 6,474,117 (Okuna) entitled "Anti-Theft Device" features a clamp member for clamping the pin of an attachment tack within a pinhole of the tag body. The tag body further houses an on-off switch which is to be depressed by a button on the attaching member and further features a theft alarm operable under the controls of on-off signals from the on/off switch. Such a system is unnecessarily complicated and is not durable or universal as a purely passive mechanism for retaining a tack shaft within a tag housing.

In general, the prior art devices suffer from a number of drawbacks that limit the applicability of the device. In some cases, the tag article is too complicated to install or remove. In other cases, the tag article is too easy to defeat. Also, many articles require a specific detachment mechanism that is unique for that style of tag, requiring the retailer to purchase additional equipment for each checkout counter, and none of the prior art tag articles can be removed by either magnetic detacher or a probe-style detacher. The present invention overcomes those obstacles.

SUMMARY OF THE INVENTION

The present invention is directed to an EAS security tag. Specifically, the present invention is an EAS security tag which is relatively small and is constructed of hard plastic or metal. The tag construction is durable and provides structural integrity for housing and electronic sensor means which is designed to create a positive reading or output upon entry of the tag into a prescribed zone of interrogation. The structure of the mechanism for creating the interrogation zone and the electronic emittance means may include a number of pre-existing systems currently available in the marketplace. The EAS tag includes a tack consisting of a head and a shaft. The shaft of the tack is inserted into the article to be protected and after piercing through said article, is inserted into the EAS tag. The tack is retained by a three-ball clutch mechanism that enables the tack shaft to be reliably and securely retained unless and until the release means for the three-ball clutch mechanism is activated.

In one aspect, the invention provides an EAS security tag which is less cumbersome for the retailer to use. This EAS tag satisfies that objective as it may be detached by either the prevalent mechanical detacher as well as the magnetic detachers on the market today.

A preferred aspect of the invention relates to a security tag designed for a single use and which can then be disposed of. In this regard, the security tag can actually be installed by the manufacturer or an entity other than the retail establishment, thus saving the retailer substantially in time and labor for installing and recycling the security tags. Once the article to which the security tag has been attached is sold, the tag is removed and discarded, as opposed to being kept for future use on other articles. This arrangement has significant benefits to the retail establishment, reducing the costs for controlling inventory. A one time use security tag can also be smaller and more compact, and placed on the article more accurately and conveniently as part of the production phase of the article.

A related aspect of the invention is to create an EAS security tag that features a minimum number of discrete parts to both minimize production cost and minimize the fail rate of the article by reducing the number of moving parts within the structure of the tag.

Another aspect of the present invention is to provide an EAS security tag wherein several pre-existing detachment means may be utilized to remove the tag at the checkout counter. This will alleviate the need to have multiple detachment means available at the checkout counter and make it easier for personnel to remove the tag such as to not slow down the checkout process.

Before explaining at least one embodiment of the invention in detail, it is to be understood that the invention is not limited in its application to the details of construction and to the arrangement of the components set forth in the following description or illustrated in the drawings. The invention is capable of other embodiments and of being practiced and carried out in various ways. Also, it is to be understood that the phraseology and terminology employed herein are for the purposes of description and should not be regarded as limiting. Further, the specification must be regarded as including such equivalent constructions insofar as they do not depart from the spirit of the present invention.

BRIEF DESCRIPTION OF THE DRAWINGS

Additional utility and features of this invention will become more fully apparent to those skilled in the art by reference to the following drawings, wherein all components are designated by like numerals and described more specifically.

DETAILED DESCRIPTION OF THE PREFERRED EMBODIMENT

Figure 1:
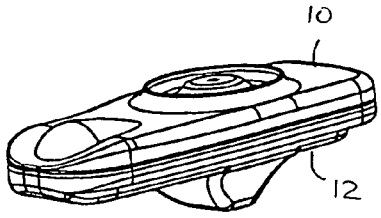
FIG. 1 is a perspective view of the security tag of the invention.

The preferred embodiment of the present invention, herein described, is a generally plastic article although other materials may also be used. The EAS tag is approximately two inches in overall length, and the tag housing consists of two molded plastic halves, a top and a bottom housing structure shown as 10 and 12 in FIGS. 1 and 2 of the drawings, respectively. Upon assembly of top half 10 and bottom half 12, a shell is formed that houses both the fastening and release mechanisms and an electronic sensing mechanism 20 (shown in FIG. 2). Upon assembly of the tag to include the essential fastening and sensing elements, the tag is placed adjacent or on to the protected article and an anchoring tack (not shown) is inserted through both. An opening 26 in the security tag receives the anchoring tack and locks it in place such that the tack, and hence the security tag, cannot be separated from each other or removed from the article unless a special tool is utilized to engage the release mechanism inside the security tag.

The electronic sensing element 20 inside the security tag is designed such that passage of the security tag through a detection field or detection zone results in an audible or visible alarm, or other triggering mechanism.

In general, the retail establishment will feature one or more permanently mounted detection mechanisms oriented above or about the exit door of the establishment. The detection equipment generates a security field of magnetic field in the vicinity of the exit and the field is tuned such as to detect the electronic sensing mechanism 20 inside the shoplifting deterrent tag if the tag were to pass through the field. The preferred embodiment described herein features a 58 KHz ferrite combined with a VST and the electronic element within the shoplifting tag is appropriately constructed and oriented to be detected by the detection mechanism, and an alarm is activated. However, the specific field generation and alarming means may vary, and the tag claimed herein is not limited to any specific field generation and alarm mechanism.

Figure 2:
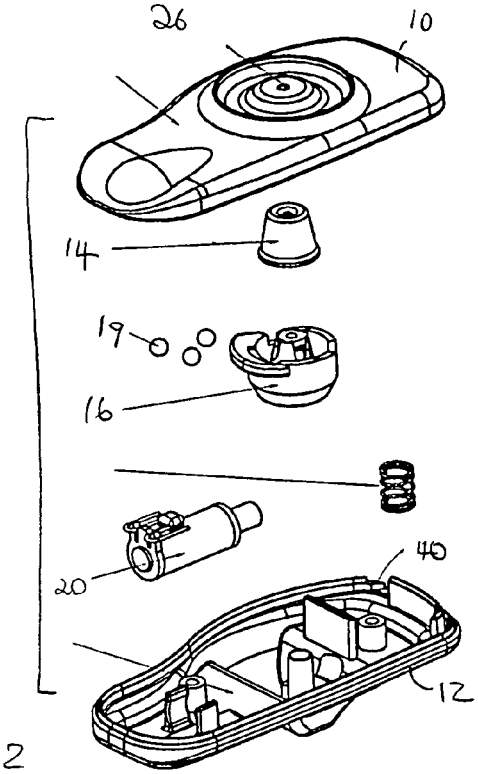
FIG. 2 is an exploded view of the security tag of the invention showing at least some of the internal components thereof, including the upper and bottom portions of the security tag which snap or fasten together to form a housing, a cup member received in a cup receiving structure, a spindle mechanism with associated ball bearings configured to cooperate with the cup member in the fastening of a tack pin to the security tag, a spring for biasing the spindle mechanism, an electronic signaling member for transmitting signals to an antenna system.
Figure 3:
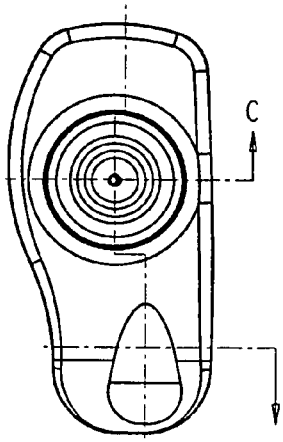
FIG. 3 is a top view of the security tag of the invention, and also showing the hole or aperture through which the tack pin is inserted.
Figure 4:
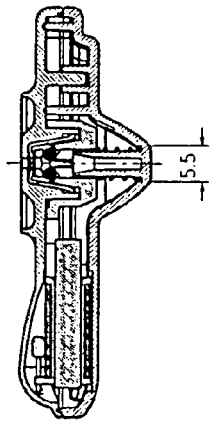
FIG. 4 is a section view through the security tag of the invention showing various internal components thereof in their operative positions.
Figure 5:
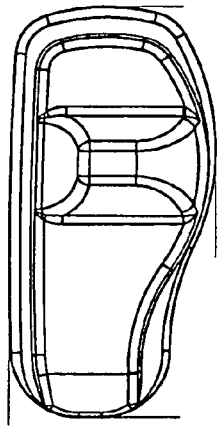
FIG. 5 is a bottom view of the security tag of the invention.
Figure 6:
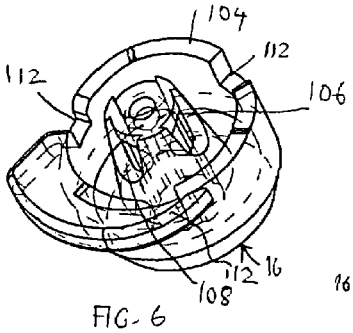
FIG. 6 is a detailed perspective view of a spindle mechanism operative in use to facilitate the securing of the tack within the tag body in accordance with one aspect o the invention, the spindle mechanism including slots in the outer wall thereof for engagement with tabs or projections on the top portion of the security tag and radially expending flange for engagement by a probe.
Figure 7:
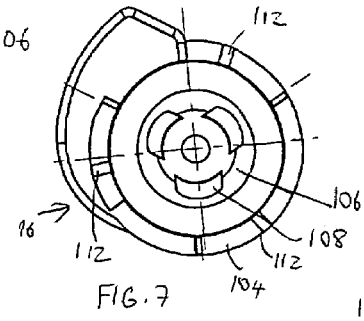
FIG. 7 is a top view of the spindle mechanism shown in FIG. 6 also showing apertures in the spindle center through which ball bearings can protrude to facilitate attachment of the tack pin in the security tag.
Figure 8:
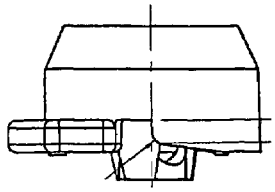
FIG. 8 is a side view of the spindle mechanism shown in FIGS. 6 and 7 of the drawings.
Figure 9:
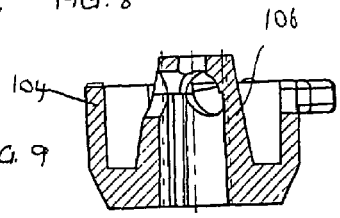
FIG. 9 is a cross section through the spindle mechanism and showing the spindle center, flange, apertures for the ball bearings and a slot for engagement with a tab.
Figure 10:
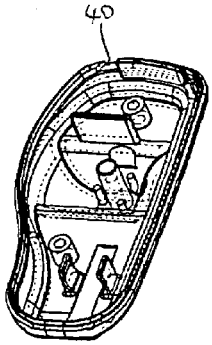
FIG. 10 is a perspective view of the inside of the bottom portion of the security tag of the invention, showing the aperture for a release probe, the receiving space and attachment for an electronic signal device, and the hollow shaft located to receive and support the spindle mechanism on the bottom portion of the security tag of the invention.
Figure 11:
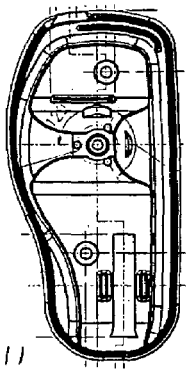
FIG. 11 is a top view of the inside of the bottom portion of the security tag of the invention as illustrated in FIG. 10 of the drawings.
Figure 12:
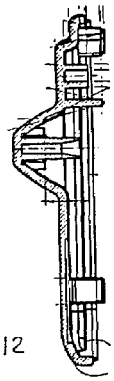
FIG. 12 is a side section through the bottom portion of the security tag of the invention showing the various components and configuration thereof.
Figure 13:
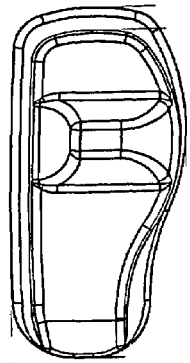
FIG. 13 is a plan view of the outside of the bottom portion of the security of the invention as shown generally in FIGS. 10, 11, and 12 of the drawings.
Figure 14:
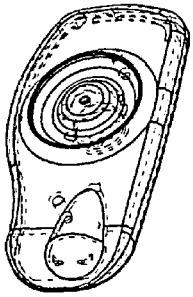
FIG. 14 is a perspective view of the outside of the upper portion of the security tag of the invention, including the aperture through which the tack pin is inserted and the concentric recesses thereabout which may be part of one embodiment of the security tag of the invention.
Figure 15:
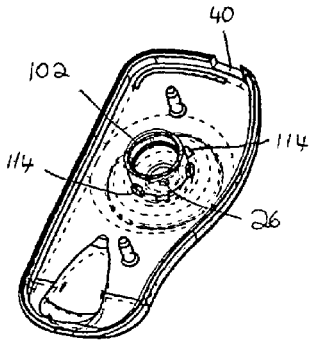
FIG. 15 is a perspective view of the inside of the upper portion of the security tag of the invention, as shown in FIG. 14 of the drawings, including the hollow cup receiving structure for receiving the cup, the hollow cup receiving member extending inwardly about the aperture through which the tack pin is inserted, and also showing the tabs or projections on the inner surface of the upper portion configured to correspond with the slots in the spindle mechanism so that when the spindle mechanism is rotated, the slots and the tabs engage each other at a predetermined radial position of the spindle mechanism relative to the upper portion.
Figure 16:
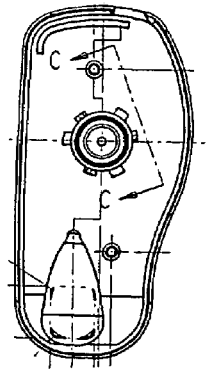
FIG. 16 is a plan view showing the inside of the upper portion of the security tag as shown in FIGS. 14 and 15 of the drawings.

A three-ball clutch mechanism engages and secures the fastening tack within and against the EAS tag housing. The components of the three-ball clutch mechanism are shown in several of the attached drawings, including FIGS. 2, 4 and 12. Specifically, the security tag interior housing is designed such as to include a "bowl-like" recessed area 102 (see FIG. 15) within the top half housing 10 about the insertion hole 26 for the anchoring tack. The recessed area 102 supports a small cup 14, within which a spindle mechanism 16 is seated. As shown in FIGS. 2 and 4, the seat of the spindle mechanism 16 is located within cup 14. The outer wall 104 the spindle mechanism 16 surround the outer perimeter of cup 14 and bowl like recessed area 102.

The spindle mechanism 16 serves as an operational member with respect to release of the anchoring tack. The spindle mechanism 16 consists of a central region 106 designed to seat comfortably inside the aforementioned cup 14. The center of the spindle mechanism 16 is hollow with three openings 108 in the perimeter of the seat. Three ball bearings 19 are disposed within the seat of the spindle mechanism 16 and the spindle seat features a hollow interior region dimensioned such that the three ball bearings 19 fit snugly within the spindle seat central region 108 which in turn is seated within the cup 14. Upon insertion of the shaft of the tack through the aperture 26 of the tag housing 12, the tack shaft enters the center of the spindle 16 such as to separate the three ball bearings 19 which were already disposed in a snug arrangement within the spindle seat. The added force of the tack shaft separates the ball bearings 19 such as to force them apart and through the holes in the spindle seat, against the limited area between the spindle mechanism 16 and the interior wall of the cup 14. As a result, the shaft of the tack is clutched by ball bearings 19 and will not be released upon tugging on the head of the tack 24.

The spindle mechanism 16 is further characterized by three slots 112 which are configured to receive three tabs 114 constructed on the inside of the upper portion of the security tag.

Further, prongs may be provided in one embodiment and may be oriented on the outer perimeter of the spindle which serve to support the spindle while also serving to couple with a molded plastic complementary seat within the plastic tag body. One of the spindle support legs is larger than the other two and serves the purpose of providing a point of contact for an operational release probe. When a probe is inserted into the body of the retail tag at the opening 40, the spindle support leg is struck and the spindle mechanism 16 may be caused to rotate accordingly. A plastic ridge along the edge of the support seat is constructed such that as the spindle mechanism is turned by striking the support leg with a probe. After the spindle mechanism 16 is turned, the spindle mechanism 16 is sufficiently removed from the cup 14 such that the ball bearings 19 are moved into a larger diameter region of the cup 14, allowing the ball bearings 19 to separate and release from contact with the shaft of the fastening tack and the cup wall. At that point, the fastening tack may be easily removed from the EAS tag housing 12.

The security tag of the invention is designed as a single use tag for disposal after it is removed from the article. Once the pin has been released, the locking mechanism becomes inoperational as a result of a non-retractable ball clutch mechanical lock. The security tag is then discarded. Since the security tag is designed for a single use only, it can be reduced in size, be more compact and can also be installed or attached to the article as part of the article production at the manufacturer's plant or assembly location. Furthermore, since it will not be re-used, it requires a simpler clutch mechanism and less of an investment in probes or other tools to separate the pin from the security tag body itself. This also results in less labor investment by the retail establishment, saving money and time but also maintaining the necessary security measures.

In order to facilitate a more effective clutching of the tack shaft by the ball bearings, the tack shaft may feature notches or flat areas in an otherwise round shaft circumference in order to provide a surface more easily anchored in the vicinity of the ball bearings.

The EAS tag disclosed herein is a very versatile article as it may alternatively be operated, in one embodiment of the invention, through the use of a magnetic detachment mechanism. In order to facilitate such an operation, the seat portion of the spindle must be constructed of a ferrous material or some other material that is highly attracted by a magnet. In use, the store clerk will place the EAS tag adjacent a magnetic detacher with the side opposite the tack facing or placed against the detacher. The detacher exerts a magnetic force which will act upon the spindle seat and draw it closer to the magnet. This force will cause a spring to compress as the magnetic force overcomes the biasing force of spring. Upon compression of the spring, the spindle will be raised from cup 14 such that ball bearings 19 are allowed into the larger diameter portion of cup 14. Accordingly, the ball bearings 19 separate and release tack 24 for removal from the tag housing 10.

The invention claimed is:

1. An electronic article surveillance tag comprising:

a) a tag housing for receiving a tack consisting of a tack head and a tack shaft wherein said tack shaft is inserted through a portion of the article to be protected and into a first opening in said tag housing;

b) a ball bearing clutching means within said tag housing for retaining a portion of said tack shaft within said tag body, the clutching means becoming inoperational for connection of the tack shaft to the tag housing after the tack pin is removed therefrom;

c) a second opening in said tag housing for insertion of a probe which operates to release said ball bearing clutching means; and d) a sensor means contained within said housing.

2. The tag of claim 1 wherein said ball bearing clutching means comprises a set of three ball bearings retained within a spindle which generally retains the balls in a spaced relationship to each other, said spindle further incorporating a central aperture which is oriented directly beneath said first opening in said tag housing such that said tack shaft is inserted through the central aperture of said spindle.

3. The tag of claim 2 wherein said spindle is further characterized as featuring a hollow annular portion within which said three ball bearings are disposed and wherein said hollow portion further features three openings along the outer wall of said annular portion sized such that a portion of said ball bearings may protrude through said openings when said tack shaft is inserted into said central aperture of said spindle.

4. The tag of claim 3 wherein said hollow annular seat portion of said spindle is made of a material which is attractive to a magnet.

5. The tag of claim 3 wherein the spindle comprises an engagement tab designed to be contacted by a probe inserted into said second opening in said tag housing such that contact of said engagement tab by said probe serves to release the clutching means.

6. The tag of claim 3 wherein said clutching means is further comprising of a cup within which said spindle and ball bearings are placed and wherein said cup is tapered gradually from the top edge of the cup to the bottom of the cup.

7. The tag of claim 6 wherein said tapered cup, spindle and ball bearings are sized such that when said tack shaft is fully inserted into said tag housing and through the central aperture of said spindle, the tack shaft will be tightly wedged between the three ball bearings which are tightly held by the wall of said tapered cup such that said shaft is prevented from being removed from the tag housing.

8. The tag of claim 6 wherein said tag housing is further characterized in that said housing features a seat portion integral to said housing, and wherein said tapered cup is disposed in said seat portion.

9. The tag of claim1 wherein a biasing means is disposed within said housing which urges a spindle into a cup.

10. The tag of claim 9 wherein said biasing means is a spring.

11. The tag of claim 1 wherein said tag housing is constructed of two pieces of hard plastic.

12. The tag of claim 6 wherein said cup is constructed of a metal.

13. The tag of claim 1 wherein said tack shaft comprises regions of varied diameter in order to assist said clutching means in maintaining a tight grip on said shaft during retention of said shaft in said housing.

14. The tag of claim 13 wherein said shaft features one or more regions wherein said shaft is flattened.

15. An electronic article surveillance tag comprising:

a) a tag housing;

b) a tack consisting of a tack head and a tack shaft wherein said tack shaft is inserted through a portion of the article to be protected and into a first opening in said tag housing;

c) a releasable ball bearing clutching means within said tag housing for retaining a portion of said tack shaft within said tag body, the clutching means being rendered inoperational once the tack pin has been removed therefrom;

d) a second opening in said tag housing for insertion of a probe which operates to release said ball bearing clutching means;

e) a biasing means for effecting the operation of said releasable ball bearing clutching means; and f) a sensor means contained within said housing.

* * * * *